US006662901B1

(12) United States Patent
Appl

(10) Patent No.: US 6,662,901 B1
(45) Date of Patent: Dec. 16, 2003

(54) LADDER CONTROL APPARATUS

(76) Inventor: Franklin J. Appl, 3503 Charleston Rd., Norman, OK (US) 73069

( * ) Notice: Subject to any disclaimer, the term of this patent is extended or adjusted under 35 U.S.C. 154(b) by 0 days.

(21) Appl. No.: 09/618,359

(22) Filed: Jul. 18, 2000

Related U.S. Application Data

(63) Continuation of application No. 09/469,528, filed on Dec. 22, 1999, now abandoned, which is a continuation of application No. 09/016,911, filed on Feb. 2, 1998, now abandoned.

(51) Int. Cl.[7] ..... E06C 9/00
(52) U.S. Cl. ..... 182/77; 182/78
(58) Field of Search ..... 182/77, 78, 79, 182/80, 81; 403/68, 370

(56) References Cited

U.S. PATENT DOCUMENTS

| | | | | |
|---|---|---|---|---|
| 453,294 | A | 6/1891 | Powers | 182/78 |
| 1,721,521 | A | 7/1929 | Marschke | 182/78 |
| 1,767,148 | A | 6/1930 | Marschke | 182/78 |
| 2,163,142 | A | 6/1939 | Frazier | 182/78 |
| 2,506,380 | A | 5/1950 | Myers | 228/50 |
| 2,595,597 | A | 5/1952 | Morseth | 287/58 |
| 2,649,237 | A | 8/1953 | Bjorklund et al. | 228/50 |
| 2,815,159 | A | 12/1957 | Harmon | 182/78 |
| 3,375,044 | A | 3/1968 | Peterson | 403/68 |
| 3,982,608 | A | 9/1976 | Booth | 182/49 |
| 5,050,706 | A | 9/1991 | Cole et al. | 182/78 |
| 5,649,780 | A | 7/1997 | Schall | 403/370 X |
| 5,685,659 | A | 11/1997 | Brosius et al. | 403/68 X |

OTHER PUBLICATIONS

Brochure of Bessler Stairway Company (1995).
Brochure of Werner Co. (Undated but admitted to be prior art).
Brochure of American Stairways, Inc., entitled "Husky Disappearing Stairway" (Undated but admitted to be prior art).
Brochure of the Marwin Company (Undated but admitted to be prior art).
Brochure of Davidson (Undated but admitted to be prior art).
Brochure of Small Parts, Inc. (Undated but admitted to be prior art).

*Primary Examiner*—Bruce A. Lev
(74) *Attorney, Agent, or Firm*—McAfee & Taft

(57) ABSTRACT

A control apparatus for a folding ladder or stairway. The control apparatus comprises a control base attachable to a section of the ladder and a control arm pivotally attached to the control base. The control arm has a distal end which may be gripped by an operator to manipulate the ladder between folded and unfolded positions while the operator is positioned away from the ladder so that unexpected pivotation of ladder sections cannot result in the ladder sections striking the operator. A clamp may be attached to the ladder to retain the distal end of the control arm when not in use. The control arm is telescoping and may be positioned in any of a variety of extended positions. A lock is provided to lock the telescoping control arm at a desired length.

9 Claims, 3 Drawing Sheets

LADDER CONTROL APPARATUS

This is a continuation of U S. patent application Ser. No. 09/469,528, filed Dec. 22, 1999 now abandoned, which is a continuation of Ser. No. 09/016,911 filed Feb. 2, 1998 now abandoned.

BACKGROUND OF THE INVENTION

1. Field of the Invention

This invention relates to apparatus for controlling the movement of a folding ladder or stairway, and more particularly, to an apparatus with a pivoted control arm to control the raising and lowering of a ladder or stairway of the type used in ceiling structures in a building.

2. Description of the Prior Art

Folding ladders or stairways are well known in the art and are frequently used in ceiling structures of buildings to provide access to attic space or upstairs rooms. Thus, these may be referred to as folding, disappearing attic ladders or stairways. Typically, such a ladder is mounted on a hinged door which fits in a framed opening in the ceiling. The ladder is folded and unseen when the door is closed and is unfolded to extend down to the floor when the door is open.

In one type of folding ladder, there are three ladder sections. A first section is fixedly attached to the door, a second section is hingedly connected at one end to the lower end of the first section, and a third section is hingedly attached to the other end of the second section. When folded, the second section is immediately adjacent to the first section, and the third section is immediately adjacent to the second section such that all sections are substantially parallel to one another. When unfolded, the sections are substantially aligned to form the ladder or stairway. Examples of such devices are manufactured by Bessler Stairway Company, Werner Co., American Stairways, Inc., The Marwin Company, and Davidson. Another example of such a folding stairway or ladder is shown in U.S. Pat. No. 2,649,237 to Bjorklund et al. These ladders usually are made of wood or metal, such as aluminum. The material of the ladder is unimportant to the present invention, however.

In these folding ladders, the door is pivotally connected at one end to a ceiling joist or other part of the building structure, and the other end of the door has a cable attached thereto which extends from the outer side of the door. The door is spring loaded to bias it toward a closed position. By pulling on the cord, the door is pivoted on the hinges and moved to an open, angularly disposed position with respect to the ceiling. The operator must then manually grasp the second or third section of the ladder to pivot the second and third sections downwardly to the unfolded operating position of the ladder. This is frequently difficult to do, particularly in high ceiling areas and for persons of short stature. The operator may have to jump up to grasp the ladder to unfold it. There is also some awkwardness in the fact that the spring tends to close the door while the operator is attempting to unfold the ladder. It is possible that the door may swing upwardly without warning while the operator's hand is extended into the ladder. Also, the ladder sections may pivot downwardly unexpectedly when lowering the ladder, causing one or more of the ladder sections to strike the operator. In fact, this latter problem has resulted in at least one fatality. All of these dangers are exacerbated if the operator has to jump to try to reach the ladder.

Therefore, there is a need for an apparatus to control the folding and unfolding of the ladder so that if a portion of the ladder pivots unexpectedly, the operator is at a safe distance from the ladder, thereby minimizing the possibility of injury. The present invention solves this problem by providing a ladder control apparatus with a pivoted control arm which allows the operator to manipulate the ladder sections while standing a safe distance from the ladder. Also, the operator can use both hands in a comfortable position to more positively control the movement of the ladder sections.

SUMMARY OF THE INVENTION

The ladder control apparatus of the present invention comprises a control base portion attachable to a folding ladder or stairway and a control arm portion pivotally connected to the base portion, whereby an operator of the apparatus may manipulate the ladder between folded and unfolded positions thereof while the operator is positioned away from the ladder. Preferably, the arm portion may be pivoted in substantially any direction with respect to the base portion, such as by connecting the arm portion to the base portion with a rod end pivot assembly or a ball and socket pivot assembly.

The apparatus further comprises means for retaining a distal or free end of the arm portion when the arm portion is not in use by the operator. In one embodiment, this means for retaining means comprises a spring biased clamp attachable to the ladder. The clamp resiliently retains the distal end of the arm portion.

In the preferred embodiment, the arm portion is a telescoping arm portion having a variably extended operating position. The apparatus further comprises locking means for locking the arm portion in a selected extended operating position. The locking means may comprise a locking ring and a rotatable collar adapted for compressing the locking ring.

Stated in another way, the apparatus of the present invention is adapted for controlling a folding ladder or stairway and comprises a base attachable to a section of the ladder and extending from a side rail thereof, and an arm having a proximal end pivotally attached to the base and a distal end by which an operator may exert pulling and pushing forces on the ladder to move it between folded and unfolded positions thereof The arm comprises an outer arm portion and an inner arm portion telescopingly received in the outer arm portion.

The present invention also includes a ladder apparatus for use in an opening in a building structure. The ladder apparatus comprises a plurality of ladder sections substantially parallel to one another when in a folded position and substantially aligned with one another when in an unfolded position. Each of the ladder sections has a pair of spaced side rails and a plurality of treads extending between the side rails. One of the ladder sections is adapted for pivotal connection with respect to the building structure adjacent to the opening therein. This ladder apparatus further comprises a control base attached to another of the ladder sections, and a control arm having a proximal end pivotally attached to the control base and a distal end adapted for gripping by an operator whereby force may be applied to the other of the ladder sections to move the ladder between folded and unfolded positions thereof The arm may be pivoted with respect to the side rail of the other of the ladder sections.

The ladder apparatus may further comprise a clamp attached to the other of the ladder sections and spaced from the control base. The clamp is adapted for grippingly retaining the distal end of the arm in a stored position when the arm is not in use by the operator.

The arm of the ladder apparatus comprises an outer arm portion and an inner arm portion telescopingly received in the outer arm portion such that a length of the arm may be selectively varied by the operator. A lock may be provided for locking the inner and outer arm portions with respect to one another when the arm is at a desired length. The lock may comprise a locking ring extending from the outer arm portion and disposed around the inner arm portion, and a collar threadingly connected to the locking ring. The collar is adapted for compressing the locking ring into locking engagement with the inner arm portion when the collar is rotated with respect to the outer arm portion. Other locking arrangements could also be used.

Numerous objects and advantages of the invention will become apparent as the following detailed description of the preferred embodiment is read in conjunction with the drawings which illustrate such embodiment.

DESCRIPTION OF THE PREFERRED EMBODIMENTS

Figure 1:
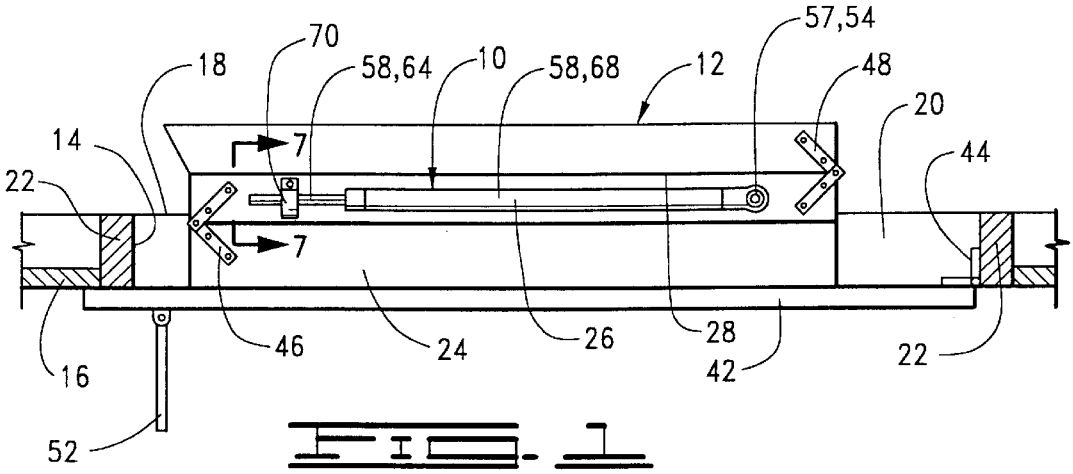
FIG. 1 shows the ladder control apparatus of the present invention in a storage position on a folding ladder or stairway which is in a stored or closed position.

Referring now to the drawings, and more particularly to FIGS. 1–4, a preferred embodiment of the ladder control apparatus of the present invention is shown and generally designated by the numeral 10, in position on a folding or disappearing ladder 12 which may also be referred to as a folding or disappearing stairway 12.

Ladder 12 is of a kind generally known in the art and is adapted to fit and operate within an opening. 14 defined in a ceiling structure 16 of a building and above a floor surface 17. Opening 14 is generally formed by a rectangular frame 18 comprising a pair of parallel longitudinal members 20 interconnected by a pair of parallel transverse members 22.

In the illustrated embodiment of ladder 12, the ladder comprises a first ladder section 24, a second ladder section 26 and a third ladder section 28. However, the number of ladder sections is not critical to the invention, and no particular number of ladder sections is required.

First ladder section 24 is constructed with a pair of longitudinally extending side rails 30 interconnected by a plurality of transversely extending treads or steps 32. Similarly, second ladder section 26 has a pair of longitudinally extending side rails 34 interconnected by a plurality of transversely extending treads or steps 36, and third ladder section 28 has a pair of longitudinally extending side rails 38 interconnected by a plurality of transversely extending treads or steps 40.

First ladder section 24 is fixedly attached to a door 42 which extends across opening 14 when the door and ladder 12 are in the closed position shown in FIG. 1. Door 42 is pivotally connected to one of transverse members 22 of frame 18 by a hinging means such as a piano hinge 44. Springs (not shown) also interconnect door 42 and longitudinal member 20 to bias door 42 toward the closed position in a manner known in the art.

Second ladder section 26 is pivotally connected to an end of first ladder section 24 opposite hinge 44 by hinges 46 which are attached to side rails 34 and 30, respectively. Similarly, third ladder section 28 is pivotally connected to the opposite end of second ladder section 26 from hinges 46 by hinges 48 which are attached to side rails 38 and 34, respectively. Some ladders have hinges on the inside as well as the outside of the side rails.

Figure 3:
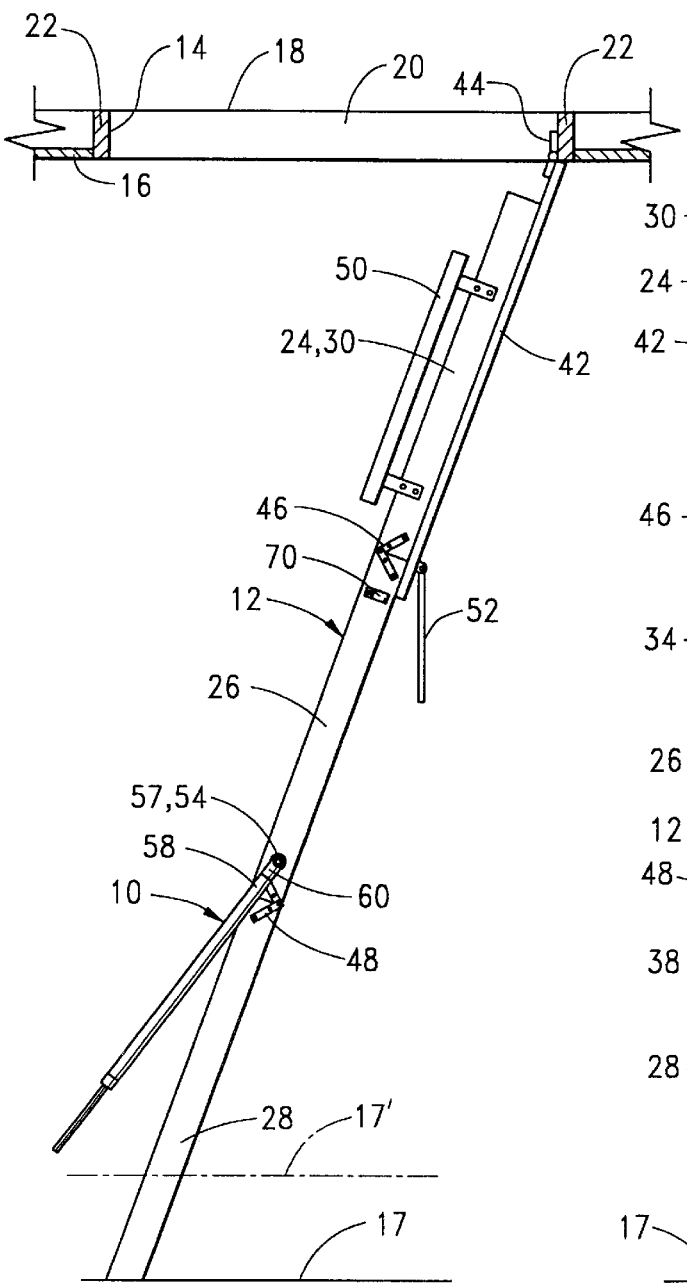
FIG. 3 illustrates the ladder control apparatus in the extended operating position and the ladder in an unfolded operating position.

The length of third ladder section may be cut to accommodate less vertical space between the ceiling and floor as illustrated by a different floor surface 17' shown in phantom lines in FIG. 3.

A hand rail 50 is attached to one of side rails 30 of first ladder section 24. For clarity, hand rail 50 is shown only in FIG. 3.

A cable 52 extends downwardly from the end of door 42 opposite hinges 44. Cable 52 is used to pull on door 42 to open it when it is desired to utilize ladder 12.

Figure 5:
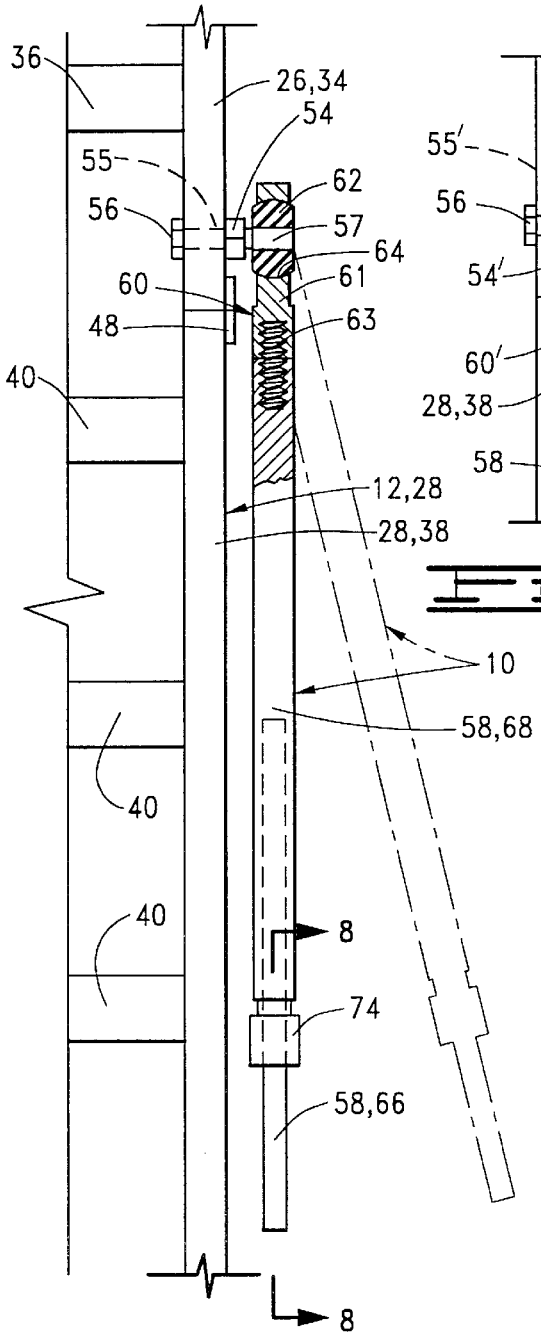
FIG. 5 is an enlarged front view of a portion of the ladder with a preferred embodiment of the ladder control apparatus thereon.

Ladder control apparatus 10 comprises a control base 54 preferably disposed on one of side rails 34 of second ladder section 26 adjacent to hinges 48. As seen in FIG. 5, control base 54 has a threaded stud portion 55 extending through the side rail. Stud portion 55 is attached to side rail 34 by a fastening means of a kind known in the art such as nut 56. Control base 54 also has a shaft portion 57 extending away from the outside of side rail 34.

A proximate end of a control arm portion 58 of apparatus 10 is connected to base portion 54 by a pivot assembly 60. In the embodiment shown in FIG. 5, pivot assembly 60 is a rod end pivot assembly 60 of a kind known in the art and having a body 61 and a bushing 62. Body 61 is attached to the distal end of control arm 58 by a stud 63 or other fastening means.

Figure 2:
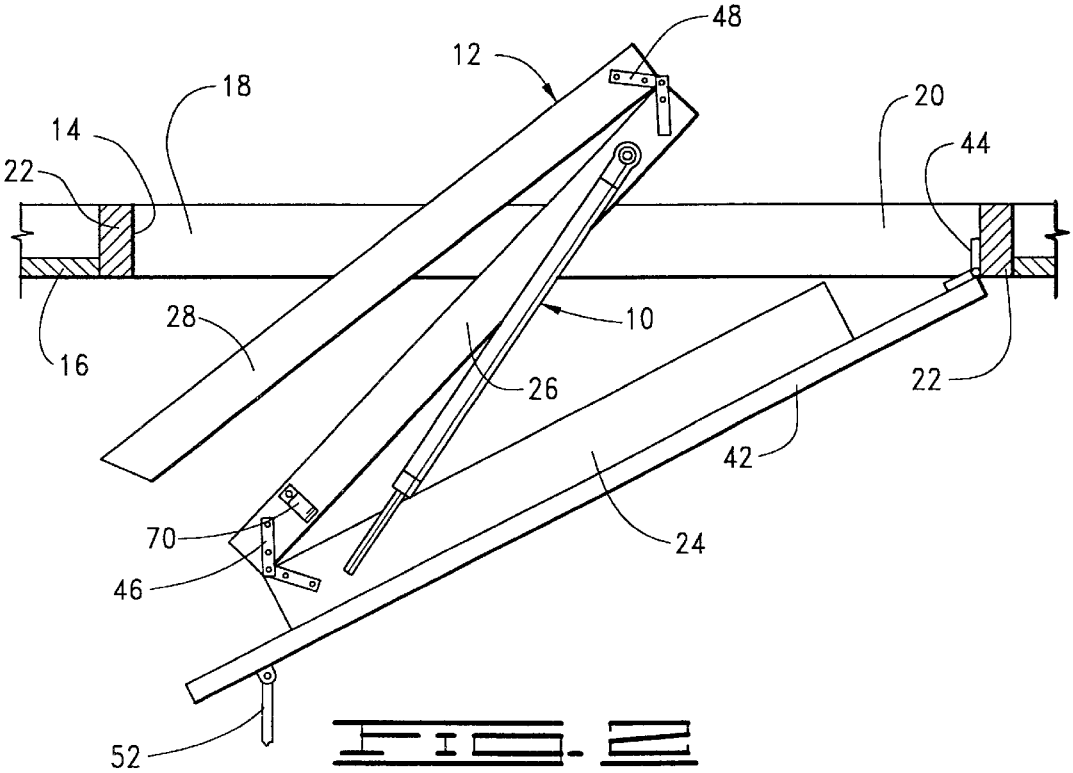
FIG. 2 illustrates the ladder control apparatus in an extended operating position with the ladder in a partially open position.

Bushing 62 is disposed around shaft portion 57 of control base 54 and this allows control arm 58 to be rotated freely about shaft portion 57 as shown in FIGS. 2, 3 and 5.

Bushing 62 of rod end assembly 60 is disposed within a curvilinear surface 64 in body 61, and as seen in phantom lines in FIG. 5, this also allows pivotation of control arm 58 angularly with respect to shaft portion 57 of control base 54 away from side rail 34 of second ladder section 26.

Figure 6:
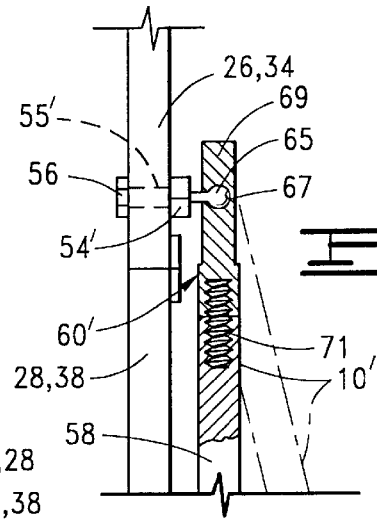
FIG. 6 shows an alternate embodiment of the ladder control apparatus.

FIG. 6 shows an alternate embodiment of ladder control apparatus 10' comprising a control base 54' connected to control arm 58 by an alternate pivot assembly 60'. Control base 54' has a threaded stud portion 55' which extends through ladder side rail 34 and is attached by a fastening means such as nut 56. Pivot assembly 60' is a ball and socket pivot assembly 60' of a kind known in the art and having a ball 65 in a socket 67 defined in a body 69. Ball 65 can be integrally formed on control base 54'. Body 69 is attached to control arm 58 by a stud 71 or other fastening means. Ball and socket pivot assembly 60' allows rotation of control arm 58 in the same manner shown in FIGS. 2, 3 and 5 for the first embodiment and further allows pivotation of the control arm away from side rail 34 angularly with respect to control base 54', as seen in FIG. 6.

Those skilled in the art will see that either rod end pivot assembly 60 or ball and socket pivot assembly 60' allows control arm 58 to be pivoted in substantially any direction with respect to base 54 or 54' such as shown in FIGS. 2, 3 and 5 and also in phantom lines in FIGS. 5 and 6. Other types of pivot assemblies could also be used, and the invention is not intended to be limited to a rod end or ball and socket pivot.

Further, while apparatus 10 is shown attached to second ladder section 26, it could be mounted on a different part of ladder 12, such as third ladder section 28, if desired.

Figure 7:
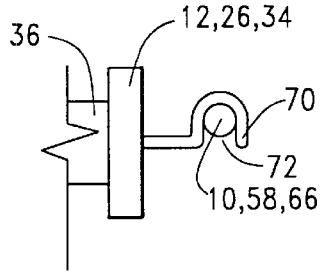
FIG. 7 is a section of the ladder taken along lines 7—7 in FIG. 1.

Control arm 58 has a telescoping configuration with an inner arm portion 66 telescopingly or slidingly received in an outer arm portion 68. Thus, control arm 58 has a variable extended operating position When ladder control apparatus 10 is not in use, a distal end of inner arm portion 66 of control arm 58 may be retained in a storage position against ladder 12 by a retaining means, such as a clamp 70 attached to an end of side rail 34 of second ladder section 26 adjacent to hinges 46. See FIGS. 5 and 7. Clamp 70 has a generally U-shaped configuration defining a gap 72 which opens downwardly in the storage position of FIG. 1. Clamp 70 is preferably made of a resilient material such as spring steel, so that gap 72 is biased to a size slightly smaller than the outside diameter of inner arm portion 66. Inner arm portion 66 may be forced into gap 72 to spread clamp 70 slightly to place the inner arm portion in the stored position shown in FIGS. 1 and 7. The spring-like action of clamp 70 thus grippingly retains inner arm portion 66 therein until forced out by an operator of ladder control apparatus 10.

Figure 8:
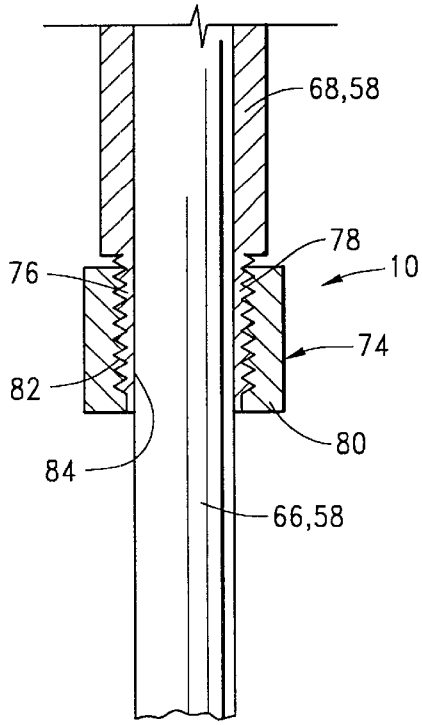
FIG. 8 shows a cross section taken along lines 8—8 in FIG. 5 and showing details of a lock for holding the ladder control apparatus in a selected extended position.

Referring to FIGS. 5 and 8, inner arm portion 66 may be locked with respect to outer arm portion 68 of control arm 58 by a lock 74. Lock 74, as illustrated, comprises a locking ring 76 which may be attached to, or integrally formed with, the distal end of outer arm portion 68. One or more longitudinally extending slots 78 are defined in locking ring 76. A locking collar 80 is engaged with locking ring 76 at threaded connection 82. Threaded connection 82 tapers slightly so that as locking collar 80 is threaded onto locking ring 76, the collar squeezes the locking ring to reduce the width of slot or slots 78. This squeezing action lockingly reduces the inside diameter of locking ring 76 and engages it against inner arm portion 66. This locking operation may be utilized at any relative position of inner arm portion 66 with respect to outer arm portion 68, and thus it may be said that lock 74 provides a means for locking inner arm portion 66 in a particular extended operating position with respect to outer arm portion 68. Other means for locking a telescoping connection could also be used.

OPERATION OF THE INVENTION

Assuming that ladder 12 is in the folded position shown in FIG. 1 with door 42 closed, the first step in utilizing the ladder is to pull on cable 52 to pivot door 42 on hinge 44 with respect to opening 14. Once door 42, and thus ladder 12, are partially pivoted, the operator may free the distal end of inner arm portion 66 of control arm 58 from clamp 70, rotate the control arm and extend the inner arm portion with respect to outer arm portion 68 to lengthen control arm 58 as desired. Control arm 58 is easy to reach because the distal end of inner arm portion 66 is originally near the bottom of the folded ladder 12. See FIG. 2.

After this, lock 74 is engaged to lock inner arm portion 66 with respect to outer arm portion 68 as previously described.

The operator may further manipulate control arm 58 with respect to control base 54 and ladder 12 as desired. One or two hands may be used. The length of control arm 58 allows the operator to control movement of ladder 12 from a position safely away. With pivot assembly 60 or 60', but not by way of limitation, control arm 58 can also be pivoted laterally away from side rail 34 of second ladder section 26 as previously described so that the operator can stand to one side of ladder 12. Thus, unexpected pivotation of second ladder section 26 and/or third ladder section 28 is prevented or will not result in the ladder sections striking the operator. By manipulating control arm 58, ladder 12 may be moved from the original folded storage position to a partially unfolded position as seen in FIG. 2 and eventually to the unfolded operating position shown in FIG. 3.

Because ladder control apparatus is attached to second ladder section 26, those skilled in the art will see that the movement of the second ladder section is completely controlled by the operator, and thus the movement of third ladder section 28 is also controlled. Even if second ladder section 26 and/or third ladder section 28 were somehow to unexpectedly pivot either together or individually, the invention allows the operator to be standing away from ladder 12 because of the degree of control provided by ladder control apparatus 10 or 10'. However, such unexpected movement is unlikely when ladder control apparatus 10 or 10' is operated properly.

Figure 4:
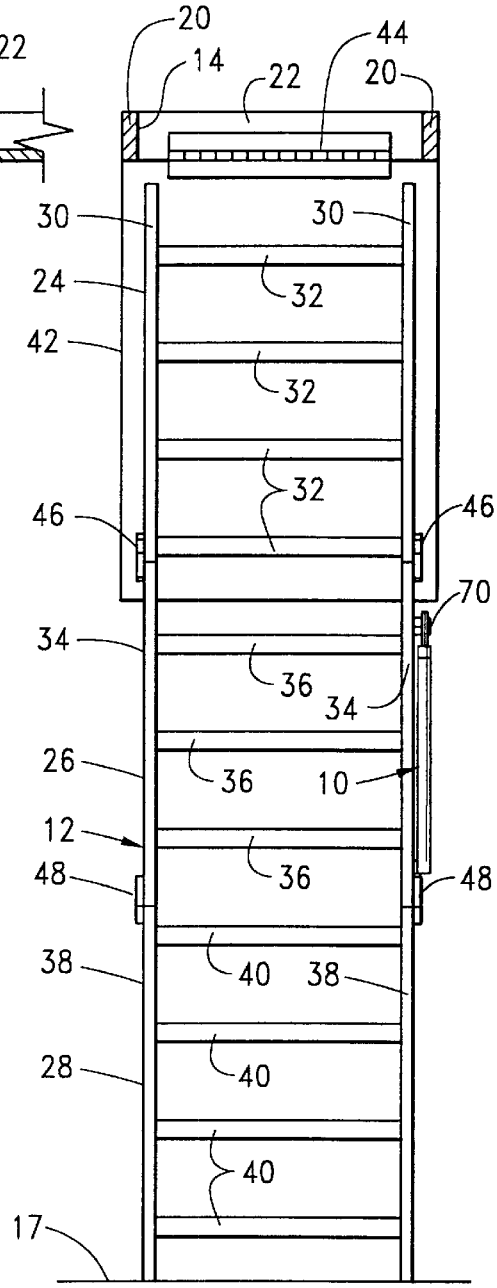
FIG. 4 illustrates a front view of the ladder in the operating position of FIG. 3.

With ladder 12 in the operating position shown in FIG. 3, lock 74 may be disengaged and inner arm portion 66 telescoped within outer arm portion 68 so that the distal end of the inner arm portion may be reengaged with clamp 70 to hold control arm 58 in its storage position as shown in FIG. 4 during use of the ladder.

When it is desired to raise ladder 12 back to its folded storage position, the procedure described above is simply reversed.

It will be seen, therefore, that the ladder control apparatus of the present invention is well adapted to carry out the ends and advantages mentioned as well as those inherent therein While presently preferred embodiments of the apparatus have been shown for the purposes of this disclosure, numerous changes in the arrangement and construction of parts may be made by those skilled in the art. All such changes are encompassed within the scope and spirit of the appended claims.

What is claimed is:

1. A folding ladder apparatus for use in an opening in a building structure, said apparatus comprising:

a plurality of ladder sections substantially parallel to one another when in a folded position and substantially aligned with one another when in an unfolded position, each of said ladder sections having a pair of spaced side rails and a plurality of treads extending between said side rails, one of said ladder sections being adapted for pivotal connection with respect to the building structure adjacent to the opening;

a control base attached to another of said ladder sections; and a control arm having a proximal end pivotally attached to said control base and a distal end, said control arm has a downwardly extending operating position wherein said distal end may be gripped by an operator while positioned laterally away from and not below the ladder whereby:

force may be applied to the other of said ladder sections to move the ladder between folded and unfolded positions thereof; and unexpected movement of any of said ladder sections cannot result in contact by the ladder with the operator.

2. The apparatus of claim 1 wherein said control base is attached to one of said side rails of said other of said ladder sections.

3. The apparatus of claim 2 wherein said arm may be pivoted in substantially any direction with respect to said side rail of said other of said ladder sections.

4. The apparatus of claim 1 wherein said arm is attached to said base by a rod end assembly.

5. The apparatus of claim 1 wherein said arm is attached to said base by a ball and socket assembly.

6. The apparatus of claim 1 further comprising a clamp attached to said other of said ladder sections and spaced from said control base, said clamp being adapted for grippingly retaining said distal end of said arm when said arm is not in use by the operator.

7. The apparatus of claim 1 wherein said arm comprises:

an outer arm portion; and an inner arm portion telescopingly received in said outer arm portion such that a length of said arm may be varied by the operator.

8. The apparatus of claim 7 further comprising a lock for locking said inner and outer arm portions with respect to one another when said arm is at a desired length.

9. The apparatus of claim 8 wherein said lock comprises:

a locking ring extending from said outer arm portion and disposed around said inner arm portion; and a collar threadingly connected to said locking ring, said collar being adapted for compressing said locking ring into locking engagement with said inner arm portion when said collar is rotated with respect to said outer arm portion.

* * * * *